US010940377B2

(12) United States Patent
Chauvin et al.

(10) Patent No.: US 10,940,377 B2
(45) Date of Patent: Mar. 9, 2021

(54) COMPOSITE BALL BATS WITH TRANSVERSE FIBERS

(71) Applicant: EASTON DIAMOND SPORTS, LLC, Thousand Oaks, CA (US)

(72) Inventors: Dewey Chauvin, Simi Valley, CA (US); Ian Montgomery, Simi Valley, CA (US); Frederic St-Laurent, Oak Park, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 16/012,085

(22) Filed: Jun. 19, 2018

(65) Prior Publication Data

US 2019/0381377 A1 Dec. 19, 2019

(51) Int. Cl.
*A63B 59/50* (2015.01)
*A63B 102/18* (2015.01)

(52) U.S. Cl.
CPC ..... *A63B 59/50* (2015.10); *A63B 2102/18* (2015.10); *A63B 2209/023* (2013.01)

(58) Field of Classification Search
CPC ..... A63B 59/50–59
USPC ..... 473/564–567
See application file for complete search history.

(56) References Cited

U.S. PATENT DOCUMENTS 1,611,858 A 12/1926 Middlekauff
3,942,794 A 3/1976 Gowins
4,014,542 A 3/1977 Tanikawa
4,025,377 A 5/1977 Tanikawa
4,093,217 A 6/1978 Piccini
4,123,053 A 10/1978 Piccini
4,132,130 A 1/1979 Fletcher
4,150,291 A 4/1979 Gulley
4,324,400 A 4/1982 Tse
4,505,479 A 3/1985 Souders
4,600,190 A 7/1986 Berokoff
4,604,319 A 8/1986 Evans
4,672,541 A 6/1987 Bromley et al.
4,681,318 A 7/1987 Lay
4,720,104 A 1/1988 Disieno
4,780,346 A * 10/1988 Denoel ..... B29C 53/08 428/176
4,804,315 A 2/1989 Ferris et al.
4,818,584 A 4/1989 Eisenmann
4,830,371 A 5/1989 Lay
4,848,745 A 7/1989 Bohannan et al.
4,867,399 A 9/1989 Therond
4,870,868 A 10/1989 Gastgeb et al.
(Continued)

FOREIGN PATENT DOCUMENTS

CA 2577184 C 4/2014
CN 1067388 A 12/1992
(Continued)

OTHER PUBLICATIONS

ASTM International, F2219-14 Standard Test Methods for Measuring High-Speed Bat Performance, USA Baseball ABI Protocol, May 2016.

(Continued)

*Primary Examiner* — Laura Davison
(74) *Attorney, Agent, or Firm* — Perkins Coie LLP

(57) ABSTRACT

A ball bat may include a barrel wall formed at least in part by a plurality of concentric first composite laminate layers and a plurality of second composite laminate layers oriented transverse to the first composite laminate layers. In some embodiments, a ball bat may include composite material with a plurality of fibers oriented along a direction transverse to the longitudinal axis of the bat.

9 Claims, 10 Drawing Sheets

(56) References Cited

U.S. PATENT DOCUMENTS 4,931,247 A 6/1990 Yeh
4,938,478 A 7/1990 Lay
4,963,408 A 10/1990 Huegli
5,048,441 A * 9/1991 Quigley ..... B29C 53/8008 114/90
5,057,353 A 10/1991 Maranci et al.
5,083,780 A 1/1992 Walton et al.
5,114,144 A 5/1992 Baum
5,123,655 A 6/1992 Rones
5,131,651 A 7/1992 You
5,150,897 A 9/1992 Wortman
5,180,163 A 1/1993 Lanctot et al.
5,188,059 A 2/1993 Rice
5,197,732 A 3/1993 Lanctot
5,284,332 A 2/1994 Ditullio
5,301,940 A 4/1994 Seki et al.
5,303,917 A 4/1994 Uke
5,362,046 A 11/1994 Sims
5,364,095 A 11/1994 Easton et al.
5,380,002 A 1/1995 Spector
5,380,003 A 1/1995 Lanctot
5,395,108 A 3/1995 Souders et al.
5,415,398 A 5/1995 Eggiman
5,419,553 A 5/1995 Rodgors
RE35,081 E 11/1995 Quigley et al.
5,490,669 A 2/1996 Smart
5,511,777 A 4/1996 Mcneely
5,516,097 A 5/1996 Huddleston
5,540,440 A 7/1996 Liu
5,556,695 A 9/1996 Mazelsky
5,593,158 A 1/1997 Filice et al.
5,620,179 A 4/1997 Mackay, Jr.
5,624,114 A 4/1997 Kelsey
5,624,115 A 4/1997 Baum
5,641,366 A 6/1997 Hohman
5,676,551 A 10/1997 Knight et al.
5,676,609 A 10/1997 Mollebaek et al.
5,676,610 A 10/1997 Bhatt et al.
5,711,728 A 1/1998 Marcelo
5,722,908 A 3/1998 Feeney et al.
5,759,113 A 6/1998 Lai et al.
5,772,541 A 6/1998 Buiatti
5,800,293 A 9/1998 Mackay, Jr.
5,804,707 A 9/1998 Scarton et al.
5,833,561 A 11/1998 Kennedy et al.
5,868,578 A 2/1999 Baum
5,899,823 A 5/1999 Eggiman
5,922,765 A 7/1999 Fleming et al.
5,954,602 A 9/1999 Eggiman et al.
5,964,673 A 10/1999 MacKay, Jr.
5,982,352 A 11/1999 Pryor
5,988,861 A 11/1999 Baum
6,007,439 A 12/1999 Mackay, Jr.
6,008,800 A 12/1999 Pryor
6,010,417 A 1/2000 Young et al.
6,022,282 A 2/2000 Kennedy et al.
6,033,758 A 3/2000 Kocher et al.
6,042,492 A 3/2000 Baum
6,042,493 A 3/2000 Chauvin et al.
6,050,910 A 4/2000 Holman et al.
6,053,827 A 4/2000 Mackay, Jr. et al.
6,053,828 A 4/2000 Pitsenberger
6,056,655 A 5/2000 Feeney et al.
6,077,178 A 6/2000 Brandt
6,146,291 A 11/2000 Nydigger
6,152,840 A 11/2000 Baum
6,159,116 A 12/2000 Pitsenberger
6,176,795 B1 1/2001 Schullstrom
6,234,922 B1 5/2001 White
6,238,309 B1 5/2001 Sample
6,248,032 B1 6/2001 Filice et al.
6,251,034 B1 6/2001 Eggiman et al.
6,265,333 B1 7/2001 Dzenis et al.
6,280,654 B1 8/2001 Digman et al.
6,287,222 B1 9/2001 Pitsenberger
6,322,463 B1 11/2001 Forsythe et al.
6,334,824 B1 1/2002 Filice et al.
6,334,825 B1 1/2002 Buiatti
6,344,007 B1 2/2002 Feeney et al.
6,352,485 B1 3/2002 Philpot et al.
6,383,100 B2 5/2002 Pitsenberger et al.
6,383,101 B2 5/2002 Eggiman et al.
6,386,999 B2 5/2002 White
6,398,675 B1 6/2002 Eggiman et al.
6,425,836 B1 7/2002 Misono et al.
6,432,007 B1 8/2002 Filice et al.
6,440,017 B1 8/2002 Anderson
6,461,260 B1 10/2002 Higginbotham
6,482,114 B1 11/2002 Eggiman et al.
6,497,631 B1 12/2002 Fritzke et al.
6,508,731 B1 1/2003 Feeney et al.
6,511,392 B1 1/2003 Chohan
6,530,852 B2 3/2003 Rios
6,533,985 B1 3/2003 Smith
6,634,969 B2 10/2003 Forsythe et al.
6,640,200 B1 10/2003 Baum
6,663,517 B2 12/2003 Buiatti et al.
6,702,698 B2 3/2004 Eggiman et al.
6,723,012 B1 4/2004 Sutherland
6,723,127 B2 4/2004 Ralph
6,729,983 B1 5/2004 Vakili et al.
6,730,047 B2 5/2004 Socci et al.
6,733,404 B2 5/2004 Fritzke et al.
6,743,127 B2 6/2004 Eggiman et al.
6,755,757 B2 6/2004 Sutherland
6,761,653 B1 7/2004 Higginbotham et al.
6,764,419 B1 7/2004 Giannetti et al.
6,767,297 B2 7/2004 Hebreo et al.
6,770,002 B2 8/2004 Aigotti
6,776,735 B1 8/2004 Belanger et al.
6,778,915 B2 8/2004 Kelly et al.
6,808,464 B1 10/2004 Nguyen
6,821,218 B2 11/2004 Byrne et al.
6,839,453 B1 1/2005 Mcwilliam et al.
6,863,628 B1 3/2005 Brandt
6,866,598 B2 3/2005 Giannetti et al.
6,869,372 B1 3/2005 Higginbotham et al.
6,872,156 B2 3/2005 Ogawa et al.
6,872,157 B2 3/2005 Falone et al.
6,875,137 B2 4/2005 Forsythe et al.
6,878,080 B2 4/2005 Chang
6,892,396 B2 5/2005 Uno et al.
6,899,648 B2 5/2005 Chang
6,905,429 B2 6/2005 Forsythe et al.
6,929,573 B1 8/2005 Chang
6,945,886 B2 9/2005 Eggiman et al.
6,949,038 B2 9/2005 Fritzke
6,969,330 B1 11/2005 Meeker
6,991,551 B2 1/2006 Tolentino et al.
6,994,641 B2 2/2006 Hebreo et al.
6,997,826 B2 2/2006 Sutherland
7,000,252 B1 2/2006 Tobin
7,006,947 B2 2/2006 Tryon, III et al.
7,008,339 B2 3/2006 Sutherland
7,011,588 B2 3/2006 Fritzke et al.
7,014,580 B2 3/2006 Forsythe et al.
7,017,427 B1 3/2006 Vacek
7,027,623 B2 4/2006 Mcwilliam et al.
7,033,291 B1 4/2006 Meeker
7,044,871 B2 5/2006 Sutherland et al.
7,052,419 B2 5/2006 Chang
7,087,296 B2 8/2006 Porter
7,097,578 B2 8/2006 Guenther et al.
7,098,891 B1 8/2006 Pryor
7,110,951 B1 9/2006 Lemelson et al.
7,115,054 B2 10/2006 Giannetti et al.
7,128,670 B2 10/2006 Souders et al.
7,140,987 B2 11/2006 Davis et al.
7,163,475 B2 1/2007 Giannetti
7,175,552 B2 2/2007 Fritzke et al.
7,207,907 B2 4/2007 Guenther et al.
7,210,172 B2 5/2007 Adams, Jr.
7,232,388 B2 6/2007 Sutherland et al.
D547,814 S 7/2007 Sims et al.

(56) References Cited

U.S. PATENT DOCUMENTS 7,300,365 B2 11/2007 Taylor
7,320,653 B2 1/2008 Fitzgerald et al.
7,331,885 B2 2/2008 Thomas
7,334,488 B1 2/2008 Vacek
7,344,461 B2 3/2008 Van
7,361,107 B2 4/2008 Giannetti et al.
7,364,520 B2 4/2008 Chauvin et al.
7,377,866 B2 5/2008 Van
7,384,354 B2 6/2008 Giannetti
7,392,717 B1 7/2008 Vacek
7,397,851 B2 7/2008 Roman
7,410,433 B2 8/2008 Guenther et al.
7,419,446 B2 9/2008 Nguyen et al.
7,431,655 B2 * 10/2008 McCarty ..... A63D 15/08 473/44
7,438,656 B2 10/2008 Davis et al.
7,442,134 B2 10/2008 Giannetti et al.
7,442,135 B2 10/2008 Giannetti et al.
7,448,971 B1 11/2008 Smalley
7,527,570 B2 5/2009 Giannetti et al.
7,572,197 B2 8/2009 Chauvin et al.
7,578,758 B2 8/2009 Thomas
7,585,235 B2 9/2009 Misono et al.
7,651,420 B1 1/2010 Gaff et al.
7,670,238 B2 3/2010 Esquerra
7,699,725 B2 4/2010 Mcnamee et al.
7,714,849 B2 5/2010 Pryor
7,744,497 B2 6/2010 Phelan, Jr.
7,749,114 B2 7/2010 Thouin
7,749,115 B1 7/2010 Cruz et al.
7,767,876 B2 8/2010 Davis et al.
7,781,640 B2 8/2010 Davis et al.
7,850,554 B2 12/2010 Burger
7,857,719 B2 12/2010 Giannetti et al.
7,867,114 B2 1/2011 Sutherland et al.
7,874,946 B2 1/2011 Smith
7,877,820 B2 2/2011 Landi et al.
7,896,763 B2 3/2011 Giannetti et al.
7,906,191 B2 3/2011 Pratt
7,914,404 B2 3/2011 Giannetti et al.
7,955,200 B1 6/2011 Cruz et al.
7,973,773 B2 7/2011 Pryor
7,980,970 B2 7/2011 Watari et al.
7,985,149 B2 7/2011 Watari et al.
7,993,223 B2 8/2011 Watari et al.
7,993,249 B1 8/2011 Fassl et al.
8,013,843 B2 9/2011 Pryor
8,029,391 B2 * 10/2011 McNamee ..... A63B 60/06 473/567
8,044,941 B2 10/2011 Pryor
8,062,154 B2 11/2011 Burger
8,068,100 B2 11/2011 Pryor
8,072,440 B2 12/2011 Pryor
8,092,322 B1 1/2012 Smallcomb et al.
8,170,095 B2 5/2012 Roman
8,182,377 B2 5/2012 Chuang et al.
8,197,366 B2 6/2012 Chauvin et al.
8,206,250 B1 6/2012 Cruz et al.
8,226,505 B2 7/2012 Burger et al.
8,228,305 B2 7/2012 Pryor
8,277,343 B2 10/2012 Chang
8,282,516 B2 10/2012 Chauvin et al.
8,298,102 B2 10/2012 Chauvin et al.
8,317,640 B1 11/2012 Cruz et al.
8,371,154 B2 2/2013 Brandt
8,376,881 B2 2/2013 Chuang et al.
8,409,038 B2 4/2013 MacDougall
8,416,847 B2 4/2013 Roman
8,427,449 B2 4/2013 Pryor
8,435,143 B2 5/2013 Vander Pol et al.
8,449,412 B2 5/2013 Vander et al.
8,467,133 B2 6/2013 Miller
8,472,120 B2 6/2013 Border et al.
8,475,304 B2 7/2013 Ou
8,477,425 B2 7/2013 Border et al.
8,480,519 B2 7/2013 Chauvin et al.
8,482,859 B2 7/2013 Border et al.
8,488,246 B2 7/2013 Border et al.
8,495,518 B2 7/2013 Boden et al.
8,506,429 B2 8/2013 Chauvin et al.
8,512,174 B2 8/2013 Epling et al.
8,512,175 B2 8/2013 Epling et al.
8,512,176 B1 8/2013 Mathew et al.
8,602,924 B2 12/2013 Shindome et al.
8,613,679 B2 12/2013 Zhesterova
8,632,428 B2 1/2014 Burger
8,702,542 B2 4/2014 Parenti
8,708,845 B2 4/2014 Chuang et al.
8,715,118 B2 5/2014 Epling et al.
8,727,917 B2 5/2014 Vander Pol et al.
8,734,274 B1 5/2014 Hochberg
8,752,419 B2 6/2014 Brandt
8,771,114 B2 7/2014 Markovich et al.
8,795,108 B2 8/2014 Chauvin et al.
8,804,101 B2 8/2014 Spagnolia et al.
8,814,691 B2 8/2014 Haddick et al.
8,814,733 B2 8/2014 Shindome et al.
8,821,322 B1 9/2014 Jorgens et al.
8,845,462 B2 9/2014 Chung
8,852,037 B2 10/2014 Epling et al.
8,858,373 B2 10/2014 Epling et al.
8,894,518 B2 11/2014 Chung
8,944,939 B2 2/2015 Clark et al.
8,964,298 B2 2/2015 Haddick et al.
8,979,682 B2 3/2015 Chuang et al.
8,992,352 B1 3/2015 Lindsay et al.
9,005,056 B2 4/2015 Pegnatori
9,039,548 B2 5/2015 Sams, III
9,067,109 B2 6/2015 Epling et al.
9,097,890 B2 8/2015 Miller et al.
9,097,891 B2 8/2015 Border et al.
9,101,810 B2 8/2015 Carlson et al.
9,128,281 B2 9/2015 Osterhout et al.
9,129,295 B2 9/2015 Border et al.
9,134,534 B2 9/2015 Border et al.
9,138,625 B2 9/2015 Chung
9,149,697 B2 10/2015 Epling et al.
9,182,596 B2 11/2015 Border et al.
9,186,562 B1 11/2015 Mathur et al.
9,186,563 B2 11/2015 Burger
9,186,564 B2 11/2015 Parenti
9,211,460 B2 12/2015 Hayes et al.
9,220,962 B2 12/2015 Van et al.
9,223,134 B2 12/2015 Miller et al.
9,229,227 B2 1/2016 Border et al.
9,233,294 B1 1/2016 Coyle
9,238,163 B2 1/2016 Hayes et al.
9,242,155 B1 1/2016 Lindsay et al.
9,242,156 B2 1/2016 Flood et al.
9,248,355 B2 2/2016 Chauvin et al.
9,257,054 B2 2/2016 Coza et al.
9,285,589 B2 3/2016 Osterhout et al.
9,289,665 B2 3/2016 Muller
9,295,890 B2 3/2016 Gans
9,308,424 B2 4/2016 Thurman et al.
9,329,689 B2 5/2016 Osterhout et al.
9,341,843 B2 5/2016 Border et al.
9,366,862 B2 6/2016 Haddick et al.
9,387,383 B2 7/2016 Hou
9,427,640 B2 * 8/2016 Davis ..... A63B 60/42
9,457,247 B2 10/2016 Fitzgerald et al.
9,457,248 B2 10/2016 Long et al.
9,463,364 B2 10/2016 Chuang et al.
9,468,823 B2 10/2016 Mitton et al.
9,486,680 B2 11/2016 Burger et al.
9,498,690 B2 11/2016 Carlson et al.
9,504,414 B2 11/2016 Coza et al.
9,504,891 B1 11/2016 Chen
9,511,267 B2 12/2016 Thurman et al.
9,744,416 B2 8/2017 Chuang et al.
10,456,639 B2 10/2019 Leinert
2001/0014634 A1 8/2001 MacKay, III
2002/0016230 A1 2/2002 Okuyama et al.
2002/0091022 A1 7/2002 Fritzke et al.

(56) References Cited

U.S. PATENT DOCUMENTS

| | | | | |
|---|---|---|---|---|
| 2002/0098924 | A1 | 7/2002 | Houser et al. | |
| 2002/0151392 | A1 | 10/2002 | Buiatti et al. | |
| 2002/0198071 | A1 | 12/2002 | Snow | |
| 2003/0153416 | A1 | 8/2003 | Anderson | |
| 2003/0186763 | A1 | 10/2003 | Eggiman et al. | |
| 2003/0195066 | A1 | 10/2003 | Eggiman et al. | |
| 2004/0077439 | A1 | 4/2004 | Eggiman et al. | |
| 2004/0132563 | A1 | 7/2004 | Giannetti et al. | |
| 2004/0132564 | A1 | 7/2004 | Giannetti et al. | |
| 2004/0176197 | A1 | 9/2004 | Sutherland | |
| 2004/0198539 | A1 | 10/2004 | Sutherland et al. | |
| 2004/0209716 | A1 | 10/2004 | Vacek et al. | |
| 2004/0221712 | A1 | 11/2004 | Stewart et al. | |
| 2005/0070384 | A1 | 3/2005 | Fitzgerald et al. | |
| 2005/0070387 | A1 | 3/2005 | Miyata et al. | |
| 2005/0143203 | A1 | 6/2005 | Souders et al. | |
| 2005/0176531 | A1 | 8/2005 | Fitzgerald et al. | |
| 2005/0227795 | A1 | 10/2005 | Fritzke | |
| 2006/0025251 | A1 | 2/2006 | Giannetti et al. | |
| 2006/0247078 | A1 | 11/2006 | Giannetti et al. | |
| 2006/0247079 | A1 | 11/2006 | Sutherland et al. | |
| 2007/0202974 | A1 | 8/2007 | Giannetti | |
| 2007/0205201 | A1 | 9/2007 | Cundiff et al. | |
| 2007/0219027 | A1 | 9/2007 | Chong | |
| 2008/0039241 | A1 | 2/2008 | Pope et al. | |
| 2008/0070726 | A1 | 3/2008 | Watari et al. | |
| 2009/0065299 | A1 | 3/2009 | Vito et al. | |
| 2009/0085299 | A1 | 4/2009 | Shibayama | |
| 2009/0130425 | A1 | 5/2009 | Whitaker et al. | |
| 2009/0181813 | A1 | 7/2009 | Giannetti et al. | |
| 2009/0215560 | A1 | 8/2009 | McNamee et al. | |
| 2009/0280935 | A1 | 11/2009 | Watari et al. | |
| 2009/0312126 | A1 | 12/2009 | Totino | |
| 2010/0160095 | A1 | 6/2010 | Chauvin et al. | |
| 2011/0165976 | A1 | 7/2011 | Chuang et al. | |
| 2011/0195808 | A1 | 8/2011 | Chauvin et al. | |
| 2011/0287875 | A1 | 11/2011 | Vander Pol et al. | |
| 2013/0045823 | A1 | 2/2013 | Sublett, Sr. | |
| 2013/0116070 | A1 | 5/2013 | Xun et al. | |
| 2013/0165279 | A1 | 6/2013 | Chuang et al. | |
| 2013/0184108 | A1 | 7/2013 | Epling et al. | |
| 2013/0316859 | A1 | 11/2013 | Burger et al. | |
| 2014/0080642 | A1 | 3/2014 | Epling et al. | |
| 2014/0179469 | A1 | 6/2014 | Berggren et al. | |
| 2014/0213395 | A1 | 7/2014 | Chuang et al. | |
| 2017/0056736 | A1 | 3/2017 | Fitzgerald et al. | |
| 2017/0252617 | A1* | 9/2017 | Caron Kardos ..... | A63B 60/48 |
| 2018/0154229 | A1 | 6/2018 | Osborne | |
| 2018/0174495 | A1 | 6/2018 | Chauvin et al. | |
| 2019/0022483 | A1 | 1/2019 | Chauvin et al. | |
| 2019/0022484 | A1 | 1/2019 | Chauvin et al. | |
| 2019/0030407 | A1 | 1/2019 | Chauvin et al. | |
| 2019/0054357 | A1* | 2/2019 | Epling ..... | A63B 60/00 |

FOREIGN PATENT DOCUMENTS

| | | | |
|---|---|---|---|
| CN | 2684892 | Y | 3/2005 |
| EP | 0585965 | | 3/1994 |
| EP | 0585965 | A1 | 3/1994 |
| WO | 2000035540 | A1 | 6/2000 |
| WO | 2004062734 | A2 | 7/2004 |
| WO | 2006015160 | A1 | 2/2006 |
| WO | 2011084847 | A1 | 7/2011 |
| WO | 2013101465 | A1 | 7/2013 |

OTHER PUBLICATIONS

Canadian Intellectual Property, Office, "Search Report and Written Opinion", for PCT/CA2016/051007, dated Nov. 3, 2016, 8 pgs.

Fibre Reinforced Plastic, Sandwich Composite and Core Material Web Page, available at http://www.fibre-reinforced-plastic.com/2010/12/sandwich-composite-and-core-material.html; dated Dec. 12, 2010, website visited Jun. 18, 2018.

IP Australia, "Patent Examination Report No. 1", for AU2012362912, dated Nov. 18, 2016.

Japanese Patent Office, "Office Action", for JP2014-550320, with English translation dated Oct. 25, 2016.

Mustone, et al., Using LS-DYNA to Develop a Baseball Bat Performance and Design Tool, 6th International LS-DYNA Users Conference, Apr. 9-10, Detroit, MI.

State Intellectual Property Office, China PRC, "First Office Action", for CN201280064601.8 with English Translation, dated Aug. 18, 2015.

Taiwan Intellectual Property Office, Official Letter and Search Report for TW101148678, with English Translation, dated Jul. 12, 2016.

USPTO, Search Report and Written Opinion for PCT/US05/26872, dated Dec. 5, 2005.

USPTO, Search Report and Written Opinion for PCT/US10/62083, dated Apr. 6, 2011.

USPTO, Search Report and Written Opinion for PCT/US12/069268, dated Apr. 15, 2013.

U.S. Appl. No. 16/132,199, filed Sep. 14, 2018, Chauvin et al.

USPTO, "Final Office Action", for U.S. Appl. No. 14/838,043, dated May 15, 2017.

USPTO, "Non-Final Office Action", for U.S. Appl. No. 14/838,043, dated Aug. 29, 2017.

USPTO, "Final Office Action", for U.S. Appl. No. 15/385,268, dated Feb. 1, 2019.

Canadian Intellectual Property, Office, "International Search Report and Written Opinion" for PCT/CA2016/051007, dated Nov. 3, 2016.

Global Plastic Sheeting, "GPS Diamond Scrim", available at https://www.globalplasticsheeting.com/gps-diamond-scrim-30-36-45-lldpe, exact publication date unknown, website visited Dec. 27, 2017.

Global Plastic Sheeting, "Poly Scrim Crawl Space Vapor Barriers", available at https://www.globalplasticsheeting.com/ultra-scrim-crawl-space-vapor-barriers, exact publication date unknown, website visited Dec. 27, 2017.

USPTO, "International Search Report and Written Opinion" for PCT/US2010/062083, dated Apr. 6, 2011.

USPTO, "Non-Final Office Action" for U.S. Appl. No. 14/838,043, dated Feb. 1, 2017.

USPTO, "Final Office Action" for U.S. Appl. No. 14/838,043, dated Feb. 22, 2018.

USPTO, "Non-Final Office Action" for U.S. Appl. No. 15/654,513, dated Sep. 28, 2018.

USPTO, "Non-Final Office Action" for U.S. Appl. No. 15/385,268, dated Jun. 29, 2018.

USPTO, Final Office Action, for U.S. Appl. No. 15/654,513, dated Apr. 25, 2019.

USPTO, Non-Final Office Action, for U.S. Appl. No. 16/132,199, dated Mar. 29, 2019.

Ellis Developments Limited, "Web Page—Through Stitching of Composites", http://www.ellisdev.co.uk/through_stitching.html, exact publication unknown, website visited Jul. 28, 2017, 2 pgs.

Ellis Developments Limited, "Web Page—Through Stitching Z-Axis Stitching", http://www.ellisdev.co.uk/thezarc.html, exact publication date unknown, webpage visited Jul. 28, 2017, 2 pgs.

Sickinger, C. et al., "Structural Stitching as a Method to design High-Performance Composites in Future", Proc. TechTextil Symposium 2001, Messe Frankfurt, Frankfurt am Main, Germany, Apr. 24-26, 2001, 10 pgs.

USPTO, Final Office Action for U.S. Appl. No. 15/385,268 dated Mar. 2, 2020, 27 pages.

USPTO, Final Office Action for U.S. Appl. No. 15/654,513 dated Mar. 13, 2020, 16 pages.

* cited by examiner

COMPOSITE BALL BATS WITH TRANSVERSE FIBERS

BACKGROUND

Composite ball bats for baseball or softball are often made with one or more layers or plies of composite laminate material. In an assembled composite bat, the composite layers are often concentrically arranged, such that an inner layer forms an inner portion of a bat wall while an outer layer forms an outer portion of a bat wall. Composite layers typically include a fiber-reinforced matrix or resin material in which the fibers are parallel with the plane of the layer, such that, in an assembled bat, the fibers are arranged circumferentially around the bat's longitudinal axis, which is often referred to as the bat's X-axis.

In a typical composite bat formed with multiple layers of composite laminate material, the volume of matrix material (sometimes in the form of resin) is higher between the layers (in the interlaminar interfaces) than in the laminate layers themselves. These areas, and other areas in which the matrix material makes up much or all of the assembly, are typically referred to as "resin-rich" areas. Resin-rich areas tend to be weaker than areas reinforced with more fibers. In a typical composite ball bat (and other composite structures), there may be resin rich veins running axially (along the X-axis) within the bat wall. Designers of composite bats consider these areas when determining the overall strength of the bat. For example, designers may analyze the interlaminar shear strength of an assembled bat.

During repeated use of composite bats, the matrix or resin of the composite material tends to crack, and the fibers tend to stretch or break. Sometimes the composite material develops interlaminar failures, which involve plies or layers of the composite materials separating or delaminating from each other along a failure plane between the layers in the interlaminar interface. For example, the plies may separate along the resin-rich areas. This "break-in" reduces stiffness and increases the elasticity or trampoline effect of a bat against a ball, which tends to temporarily increase bat performance. Typically, the separation of the plies along the resin-rich areas results in fracturing between the plies, but the fibers in the plies generally resist cracking through the thickness of the plies.

As a bat breaks in, and before it fully fails (for example, before the bat wall experiences a through-thickness failure), it may exceed performance limitations specified by a governing body, such as limitations related to batted ball speed. Some such limitations are specifically aimed at regulating the performance of a bat that has been broken in from normal use, such as BBCOR ("Bat-Ball Coefficient of Restitution") limitations.

Some unscrupulous players choose to intentionally break in composite bats to increase performance. Intentional break-in processes may be referred to as accelerated break-in (ABI) and may include techniques such as "rolling" a bat or otherwise compressing it, or generating hard hits to the bat with an object other than a ball. Such processes tend to be more abusive than break-in during normal use, and they exploit the relatively weak interlaminar shear strength of resin-rich areas found in the composite structures of typical ball bats to try to increase batted ball speed. Some sports governing bodies require that composite bats meet certain standards even after an ABI procedure in order to limit the increase in performance from use and abuse of a composite bat.

SUMMARY

Representative embodiments of the present technology include a ball bat with a barrel wall formed at least in part by a plurality of concentric first composite laminate layers and a plurality of second composite laminate layers oriented transverse to the first composite laminate layers. In some embodiments, a ball bat may include composite material with a plurality of fibers oriented along a direction transverse to the longitudinal axis of the bat.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to composite ball bats with transverse fibers and associated systems and methods. Various embodiments of the technology will now be described. The following description provides specific details for a thorough understanding and enabling description of these embodiments. One skilled in the art will understand, however, that the invention may be practiced without many of these details. Additionally, conventional or well-known aspects of ball bats and composite materials may not be shown or described in detail so as to avoid unnecessarily obscuring the relevant description of the various embodiments. Accordingly, embodiments of the present technology may include additional elements, or may exclude some of the elements described below with reference to FIGS. 1-11, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball but the technology may be used in other activities, and it is not limited to use with ball bats.

Figure 1:
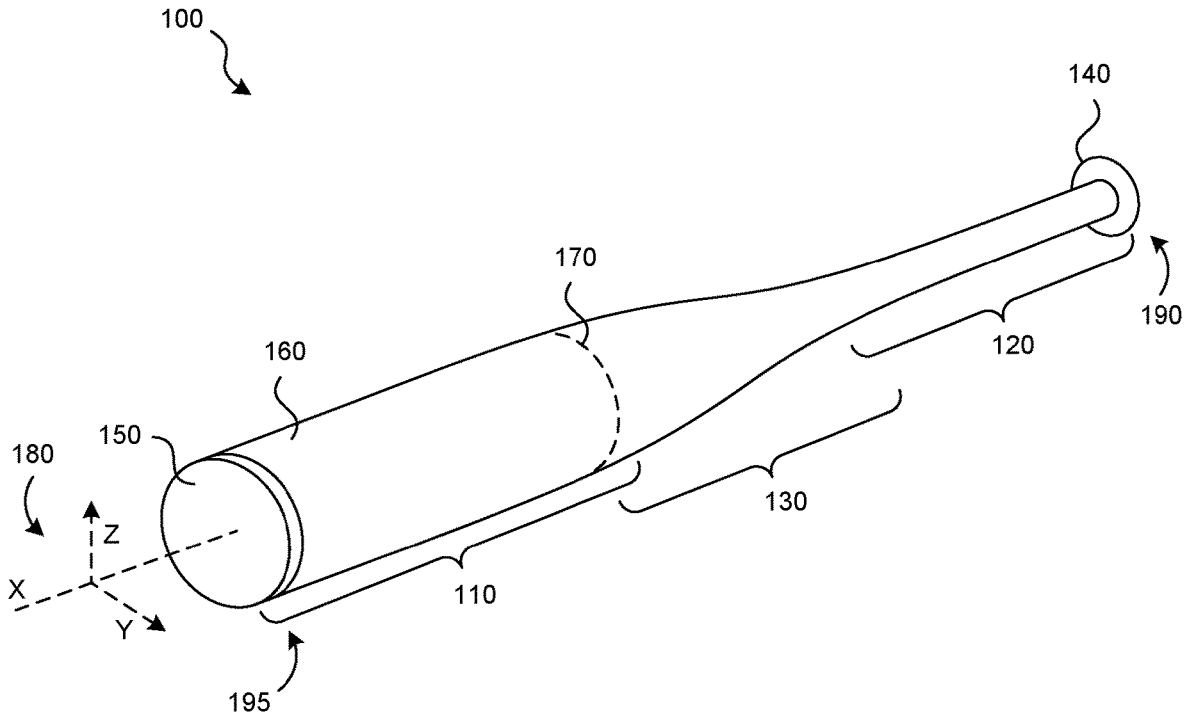
FIG. 1 illustrates a ball bat according to an embodiment of the present technology.

FIG. 1 illustrates a ball bat 100 having a barrel portion 110 and a handle portion 120. There may be a transitional or taper portion 130 in which a larger diameter of the barrel portion 110 transitions to a narrower diameter of the handle portion 120. The handle portion 120 may include an end knob 140, and the barrel portion 110 may optionally be closed with an end cap 150. The barrel portion 110 may include a non-tapered or straight section 160 extending between the end cap 150 and an end location 170. In various embodiments, the taper portion 130 may include some of the barrel portion 110, or it may include some of the handle portion 120.

The bat 100 may have any suitable dimensions. For example, the bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly among users.

The barrel portion 110 may be constructed with one or more composite materials. Some examples of suitable composite materials include laminate plies reinforced with fibers of carbon, glass, graphite, boron, aramid (such as Kevlar®), ceramic, or silica (such as Astroquartz®). The handle portion 120 may be constructed from the same materials as, or different materials than, the barrel portion 110. In a two-piece ball bat, for example, the handle portion 120 may be constructed from a composite material (the same or a different material than that used to construct the barrel portion 110), a metal material, or any other material suitable for use in a striking implement such as the bat 100.

The ball striking area of the bat 100 typically extends throughout the length of the barrel portion 110, and may extend partially into the taper portion 130 of the bat 100. The barrel portion 110 generally includes a "sweet spot," which is the impact location where the transfer of energy from the bat 100 to a ball is generally maximal, while the transfer of energy (such as shock or vibration) to a player's hands is generally minimal. The sweet spot is typically located near the bat's center of percussion (COP), which may be determined by the ASTM F2398-11 Standard. Another way to define the location of the sweet spot is between the first node of the first bending mode and the second node of the second bending mode. This location, which is typically about four to eight inches from the distal free end of the bat 100 (the end with the optional cap 150), generally does not move when the bat is vibrating. For ease of measurement and description, the "sweet spot" described herein coincides with the bat's COP.

For purposes of orientation and context for the description herein, FIG. 1 also illustrates a bat coordinate system 180 having axes X, Y, Z. The X axis corresponds with the longitudinal axis of the bat 100, spanning along the length of the bat between the proximal end 190 and the distal (free) end 195. The Y and Z-axes are orthogonal to the X-axis and to each other when the composite material (such as composite laminate plies) is generally flat, prior to forming in a rounded shape. In an assembled bat, the Z axis is oriented generally along a radial direction extending from the X-axis, transverse to the bat wall, while the Y-axis becomes generally circumferential around the bat wall in a completed bat. For ease of description herein, the Z-axis will be used to refer to the radial direction passing through the thickness of a wall of the bat 100.

Figure 2:
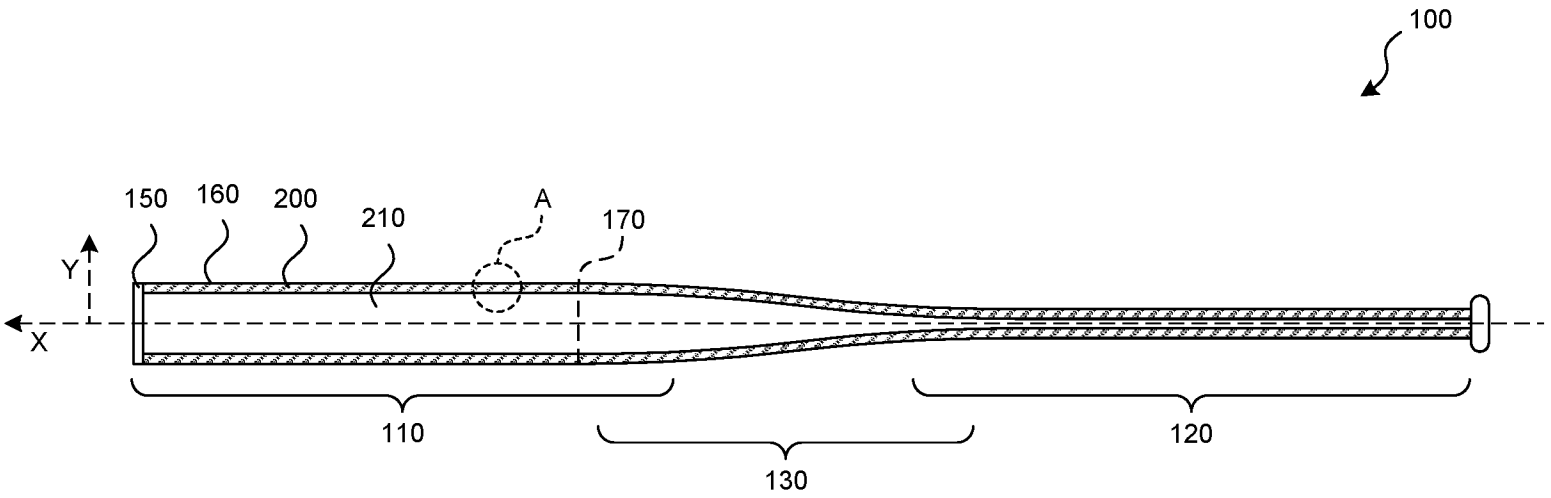
FIG. 2 illustrates a cross-sectional view of the bat shown in FIG. 1.

FIG. 2 illustrates a cross-sectional view of the bat 100 shown in FIG. 1. In some embodiments of the present technology, the ball bat may include a barrel wall 200 surrounding a hollow interior 210. In some embodiments, the interior 210 need not be hollow throughout the entirety of the bat 100. For example, a bat 100 according to embodiments of the present technology may optionally include various supports or fillers in the interior 210.

Figure 3:
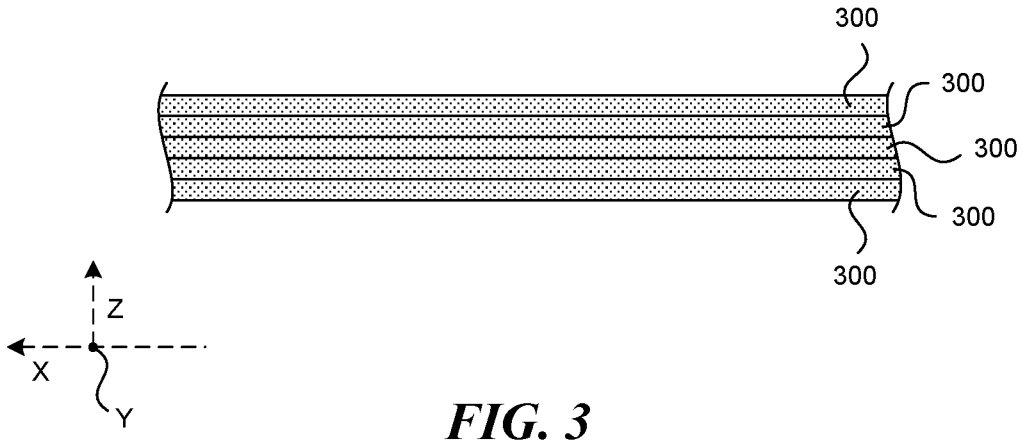
FIG. 3 (Prior Art)
FIG. 3 illustrates a cross-section of the barrel wall of a bat according to the prior art.

FIG. 3 illustrates a cross-section of a typical barrel wall according to the prior art. The cross-section may be positioned in an area similar to area A shown in FIG. 2, or elsewhere along a bat. A typical prior art composite ball bat includes one or more layers of composite laminate 300, each layer including fibers in a matrix material, such as a resin. In an assembled bat, the layers 300 are stacked in a concentric manner relative to the longitudinal or X-axis of the bat. As described above, prior art composite ball bats may fracture along the X-axis between the layers 300, which is known as interlaminar shear failure. The fiber planes in typical prior art ball bats are oriented in the X-Y plane along the X-axis, along the Y-axis (projecting in and out of the drawing sheet for FIG. 3), or along a direction angled between the X-axis and the Y-axis.

Figure 4:
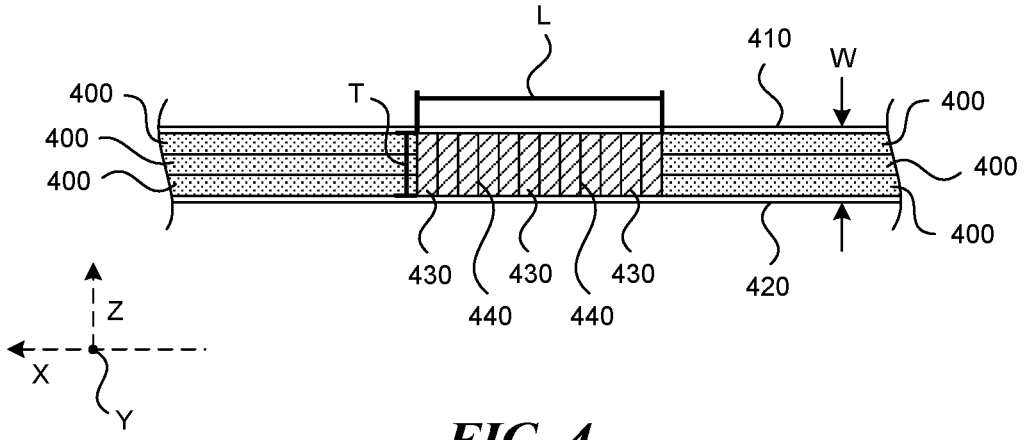
FIG. 4 illustrates a cross-section of a barrel wall of a bat according to an embodiment of the present technology.

FIG. 4 illustrates a cross-section of a barrel wall 200 according to an embodiment of the present technology. For example, this section may be positioned in Area A in FIG. 2 (or elsewhere in the ball striking area). In some embodiments, the barrel wall may include a plurality of primary or concentric layers 400 of composite laminate material (which are arranged concentrically about the longitudinal or X-axis). For example, in some embodiments, the barrel wall may include between two and ten or more concentric layers 400 of composite laminate material. Optionally, in some embodiments, the concentric layers 400 of composite laminate material may be covered with an outer skin 410, an inner skin 420 (facing the hollow interior 210 of the ball bat), or both an outer skin 410 and an inner skin 420. In some embodiments, the outer skin 410 may include a layer of composite laminate material or another suitable assembly of composite layers. In other embodiments, the outer skin 410 may include an elastomeric material or a reinforced elastomeric material. In some embodiments, the inner skin 420 may be formed with the same material(s) as the outer skin 410, or in other embodiments, the inner skin 420 may include different materials.

In accordance with an embodiment of the present technology, one or more secondary layers 430 of composite laminate material may be positioned in the wall and oriented generally along the Z-axis, in the Z-Y plane, transverse (such as perpendicular or oblique) to the concentric layers 400. Such an arrangement provides radially-oriented interlaminar interfaces or shear areas between the secondary layers 430 along the Z-axis, in the Z-Y plane. For example, a resin-rich area may be formed between the layers 430 but oriented along the Z-axis (radially) rather than along the longitudinal X-axis (as is the case for the resin-rich areas between the concentric layers 400).

When subjected to an ABI procedure, a barrel wall according to embodiments of the present technology may develop faults or cracks, or fail through the thickness of the wall (along the Z-axis), rather than along the length (X-axis) of the wall. The secondary layers 430 may also stop the proliferation of cracks or faults between the concentric layers 400. By orienting the fiber axes in the Z-Y plane (radially), the hoop stiffness of the barrel will remain generally intact even if the veins of resin between secondary layers 430 have cracked. This limits or resists increases in trampoline effect from normal break-in or ABI.

In some embodiments, the secondary layers 430 may be made of the same material as, or different material from, the primary or concentric layers 400. In some embodiments, the fibers in the secondary layers 430 may be uniformly aligned with each other along a direction in the Z-Y plane. For example, in some embodiments, the fibers may be aligned with the Z-axis, or they may be aligned with the Y-axis, or they may be aligned with a direction between the Z-axis or the Y-axis, such as between 0 and 90 degrees relative to the Z-axis. In some embodiments, the fibers may be oriented in a hoop arrangement or a circumferential direction around the barrel. In other embodiments, the fibers may be radially-oriented along directions extending from the bat's X-axis, or otherwise transverse to the X-axis. In other embodiments, the fibers in the secondary layers 430 may be aligned in other directions, and in accordance with various embodiments, they may or may not be uniformly aligned.

For ease of description only, an arrangement or grouping of secondary layers 430, such as the arrangement or grouping of secondary layers 430 illustrated in FIG. 4, may be referred to as a "Z-stack" herein. In some embodiments, a Z-stack may occupy a full length of the striking area of a ball bat. For example, a Z-stack may occupy the full length of the barrel portion 110, and, optionally, part of the taper portion 130. In some embodiments, a plurality of separate Z-stacks (Z-stacks spaced apart from each other) may be distributed along a full length of the striking area or along other suitable areas of the bat. In some embodiments, a Z-stack may be positioned at (such as centered around) the sweet spot of the ball bat, or at the center of the striking area.

In some embodiments, a designer may select a length L of a Z-stack based on the interlaminar strength of the other parts of the barrel wall (for example, the primary or concentric layers 400) and the desired performance (such as trampoline effect) of the bat. A longer length L of a Z-stack correlates with less performance increase in the bat during use or abuse, such as ABI. In some embodiments, a length L of a Z-stack may be between approximately 0.125 inches and 10 inches. In some embodiments, a length L of a Z-stack may be between one inch and four inches, depending on the length of the ball striking area and the characteristics of the resin-rich areas between various layers, or on other factors.

In some embodiments, a thickness T of a Z-stack may be selected based on the interlaminar strength of the materials in the Z-stack (such as the type of composite ply). The interlaminar strength correlates with the strength of the interlaminar interfaces 440, which are the interfaces between adjacent secondary layers 430 in the Z-stack.

For example, if the materials in the Z-stack have high interlaminar strength, the thickness T of the Z-stack (which may also be the thickness T of the interlaminar interfaces between the secondary layers 430) may be approximately five to ten percent of the overall wall thickness W. In some embodiments, the Z-stack thickness T may be 75 percent or more of the overall wall thickness W. In general, the Z-stack thickness T may be any suitable fraction of the overall wall thickness W, and the Z-stack thickness T may be limited to what is suitable for preventing or at least resisting exceeding the interlaminar strength of the primary layers 400 during use or abuse.

As illustrated in FIG. 4, the Z-stack (formed with secondary layers 430) may be positioned between the outer skin 410 and the inner skin 420, such that the Z-stack abuts the skins 410, 420. However, in some embodiments, the Z-stack may be radially positioned between concentric layers 400, for example, there may be one or more concentric layers 400 in a radially outward position (along the Z-axis) relative to the Z-stack, and one or more concentric layers 400 in a radially inward position (along the Z-axis) relative to the Z-stack, such that the Z-stack is sandwiched between primary layers 400 along the Z-axis. In particular embodiments, there may be one, two, or more concentric layers 400 positioned radially outwardly (in the Z-direction) from the Z-stack, and one, two, or more concentric layers 400 positioned radially inwardly from the Z-stack.

In some embodiments, a bat wall, such as a barrel wall 200 (see FIG. 2), may include twenty to thirty composite laminate plies, such as 26 plies, forming the concentric layers 400, while the Z-stack may include secondary layers 430 that together have a thickness T along the Z-axis corresponding to 22 to 24 of the concentric layers 400. Accordingly, in some embodiments, the Z-stack may make up a majority of the wall thickness W. In some embodiments, at least ten percent of the overall wall thickness W of a bat, such as a barrel wall 200, may comprise fibers in the Z-Y plane, in secondary layers 430.

The secondary layers 430 (and their corresponding fibers therein) may be transverse (such as perpendicular or oblique) to the primary or concentric layers 400, or otherwise oriented generally along the Z-axis. Accordingly, interlaminar interfaces 440 between the secondary layers 430 may be transverse (such as perpendicular or oblique) to the concentric layers 400.

Figure 5:
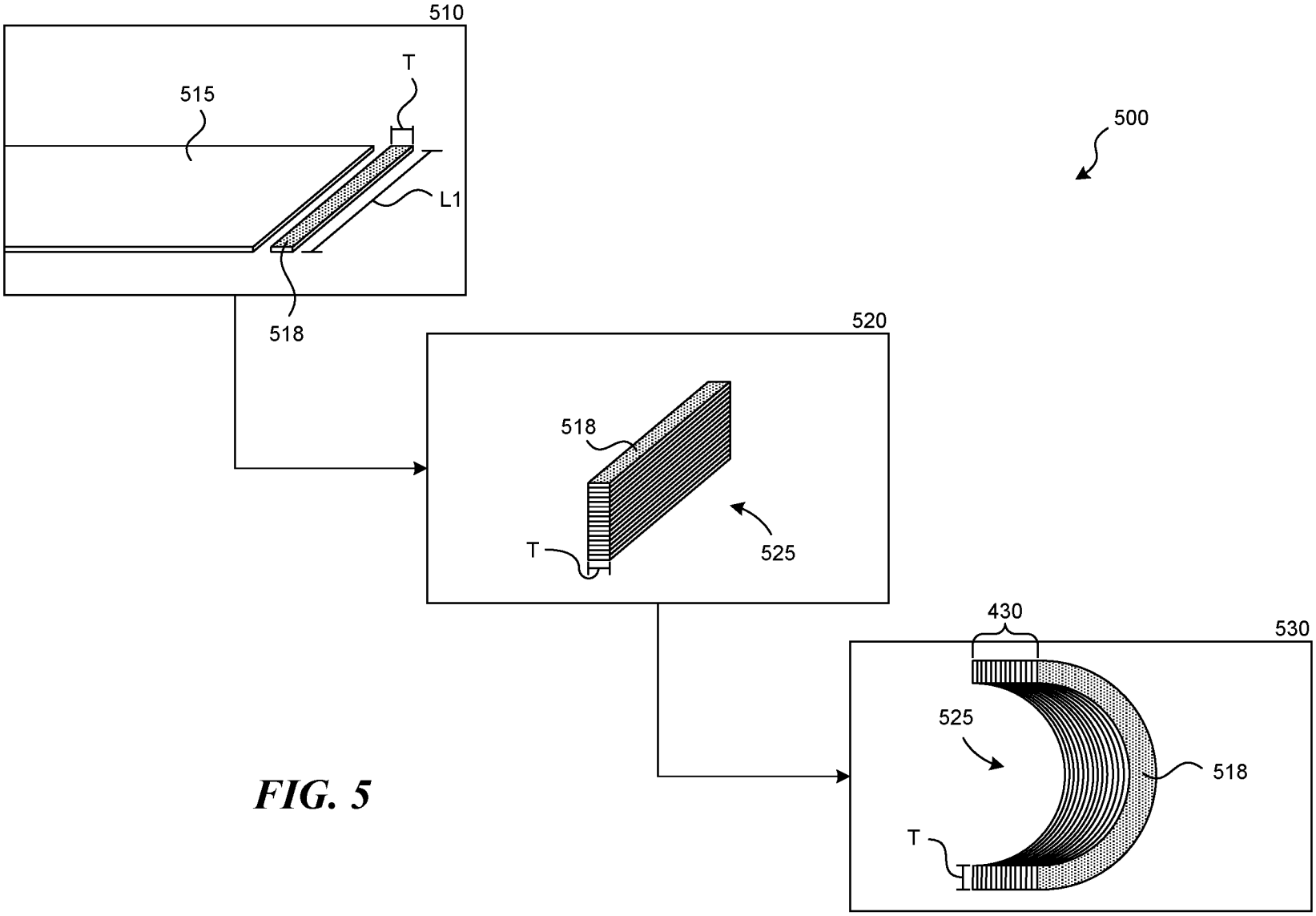
FIG. 5 illustrates a method of making secondary layers of a bat wall according to an embodiment of the present technology.

FIG. 5 illustrates a method 500 of making the secondary layers 430, according to an embodiment of the present technology. In a first step, as illustrated in box 510, a sheet 515 of composite laminate material is cut into pieces, such as strips 518. Each strip 518 may have a width equivalent to the thickness T of a Z-stack. In some embodiments, each strip 518 may have the same width but, in other embodiments, each strip may have different widths.

Each strip 518 may have a length L1 equal to or approximately equal to one half of the circumference of a Z-stack. A bat designer would understand how to select the circumference of a Z-stack based on the dimensions of a ball bat and the position of the Z-stack in the bat (such as in the barrel wall 200), using basic geometry considerations. In a second step, in box 520, the strips 518 may be arranged in a stack 525. The number of strips 518 in a stack 525 may correspond to the length L of a Z-stack (see FIG. 4) and may depend on the thickness of each individual strip 518. In a third step, in box 530, the stack 525 may be bent around a mandrel or otherwise curved to form half of a Z-stack to be laid up with the primary or concentric layers 400 of composite laminate (see FIG. 4). The method 500 may be repeated to form the other half of the Z-stack. The strips 518 may deform slightly when being curved, but they may conform during the curing process.

Figure 6:
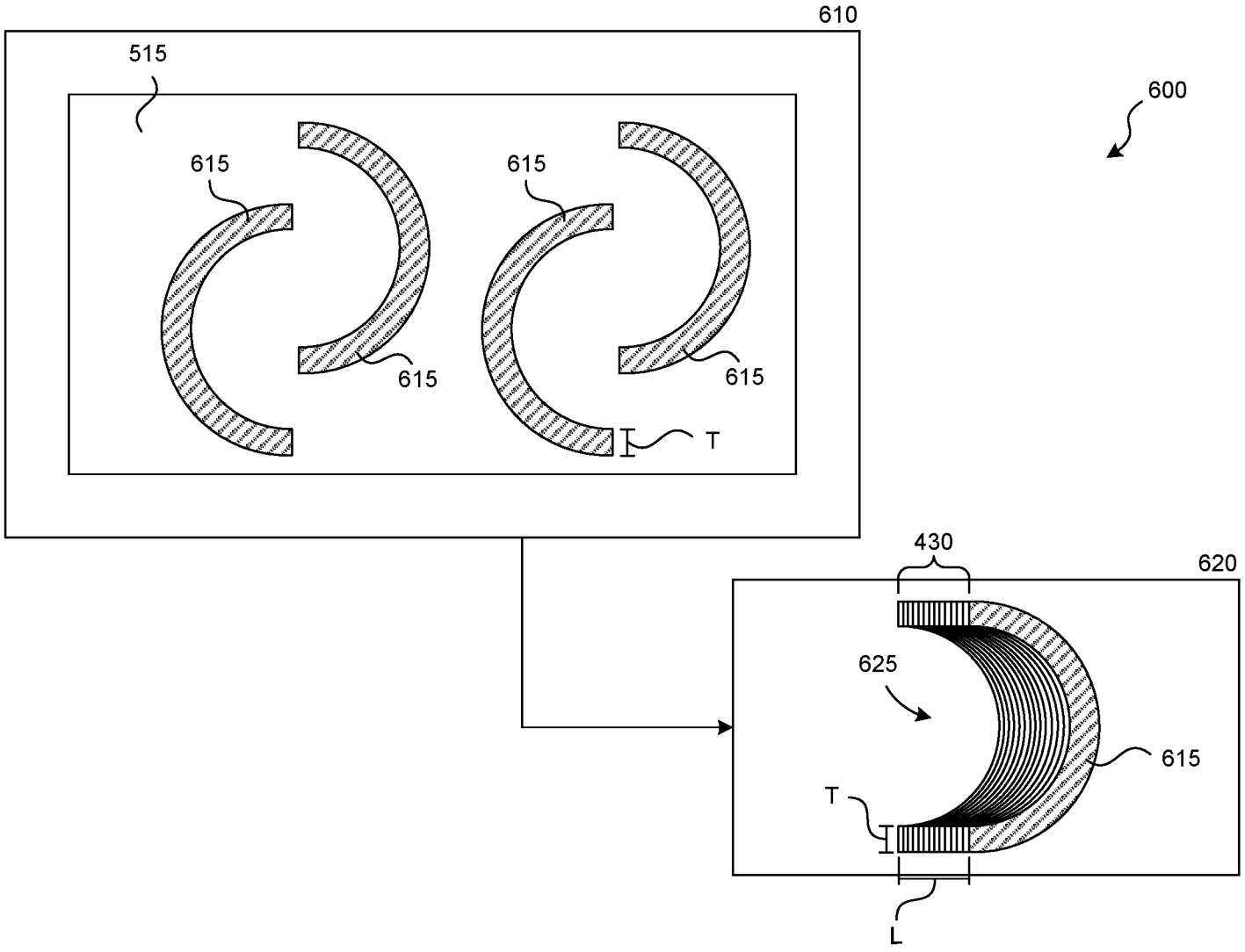
FIG. 6 illustrates a method of making secondary layers of a bat wall according to another embodiment of the present technology.

FIG. 6 illustrates a method 600 of making the secondary layers 430, according to another embodiment of the present technology. In a first step, in box 610, a sheet 515 of composite laminate material may be cut into curved pieces, such as curved strips 615. The curved strips 615 may have a width equivalent to the thickness T of a Z-stack. A bat designer would understand how to select the radius of each curved strip 615 based on the dimensions of a ball bat and the position of the Z-stack in the bat (such as in the barrel wall 200), using basic geometry considerations. In a second step, in box 620, the curved strips 615 may be placed in a stack 625, forming a Z-stack of secondary layers 430. The number of strips 615 in a stack 625 may correspond to the length L of a Z-stack (see FIG. 4) and may depend on the thickness of each individual curved strip 615. The method 600 may form a semicircular stack 625, and the method may be repeated to form a second semicircular stack 625, which may be laid up with the concentric layers 400 of composite material (see FIG. 4) to form a composite bat.

The methods 500, 600 illustrated in FIGS. 5 and 6 may use prepreg sheets 515 of composite material or, in some embodiments, the sheets 515 may be dry fiber mats, which may be wetted and cured later in the overall bat assembly using a resin transfer molding (RTM) process. Although each of FIGS. 5 and 6 illustrate semicircular stacks 525, 625, in some embodiments, the methods may include forming the stacks as complete circles before placing them into the overall composite bat assembly.

Figure 7:
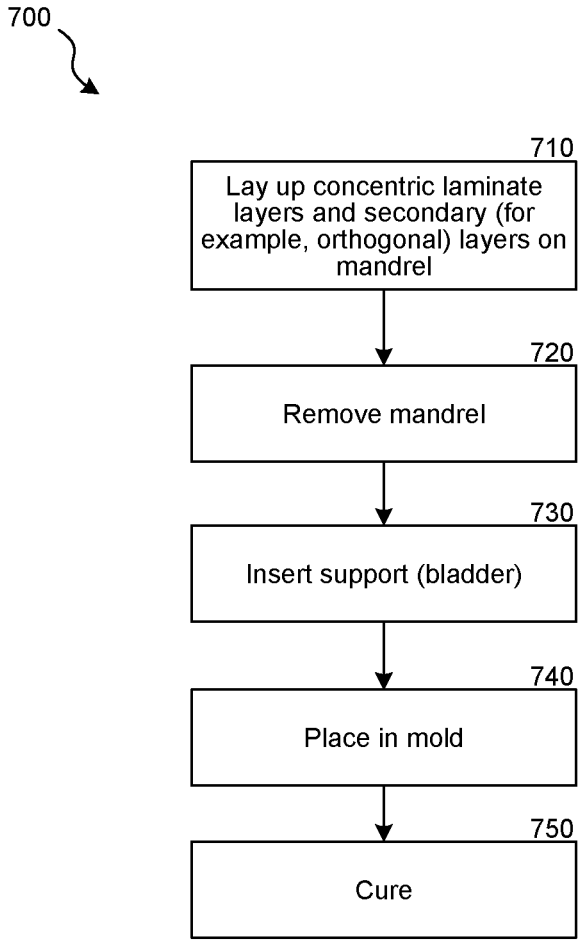
FIG. 7 illustrates a method of assembling a ball bat according to an embodiment of the present technology

FIG. 7 illustrates a method 700 of assembling a ball bat according to an embodiment of the present technology. In step 710, the concentric layers 400 are laid up on a mandrel, along with the secondary layers 430 (which form a Z-stack). The concentric layers 400 and the secondary layers 430 (for example, transverse layers) may be uncured prepreg material in step 710. In step 720, the mandrel may be removed. In step 730, a supporting element, such as a bladder shaped generally like a ball bat, may be inserted into the layers where the mandrel was previously positioned. In step 740, the bladder and the layers 400, 430 may be placed in a mold for curing in step 750 to create a ball bat according to an embodiment of the present technology (a knob 140 and end cap 150 may also be added). Although the method 700 may include laying up layers of prepreg material, in some embodiments, fiber mats may be used for the concentric layers 400 or the secondary layers 430 instead of prepreg material, and the fiber mats may be laid up on a mandrel for a resin transfer molding (RTM) process.

Figure 8:
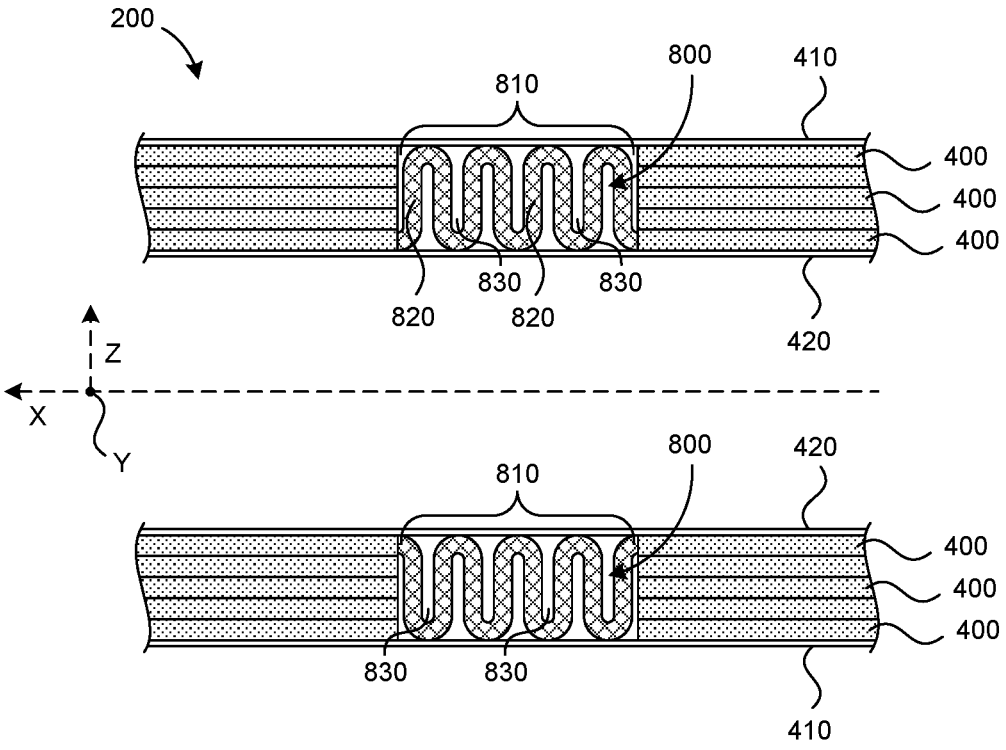
FIG. 8 illustrates a cross-section of a portion of a bat wall according to another embodiment of the present technology.

FIG. 8 illustrates a cross-section of a portion of a ball bat according to another embodiment of the present technology. For example, FIG. 8 may illustrate a portion of the barrel wall 200 (see also, FIG. 2). The cross-section is shown symmetrically arranged relative to the longitudinal X-axis of the ball bat. In some embodiments, the barrel wall 200 may be formed using a plurality of concentric layers 400, an optional outer skin 410, and an optional inner skin 420. In some embodiments, a Z-stack may be formed without cutting or forming layers or strips of composite laminate material. For example, in some embodiments, a Z-stack 800 may be formed by positioning a tube or sock 810 of fiber material or pre-preg composite material on a mandrel and compressing it along the X-axis to cause it to wrinkle into layers 820. Although the layers 820 are illustrated with gaps therebetween, in some embodiments, the layers 820 may be directly adjacent to each other as the tube or sock 810 is compressed into its wrinkled form. The adjacent layers 820 function as secondary layers (similar to the secondary layers 430 described above with regard to FIGS. 4-6) to provide interlaminar interfaces 830 in the Z-Y plane.

In some embodiments, the sock 810 may be a tube formed with a pre-preg material having woven or braided glass, carbon, or aramid fibers, or any other suitable fiber material, including other fiber materials mentioned herein. The sock 810 may be pushed onto a mandrel between the concentric layers 400 (to form the wrinkles and layers 820) and co-cured with the concentric layers 400.

In some embodiments, the sock 810 may not be a pre-preg material. For example, in some embodiments, the sock 810 may be made of fibers, and a layer of resin film may be placed on top of the sock 810 to wet the sock 810 during the curing process. An example method of making an embodiment of the present technology is to place the inner skin material 420 on a bat-shaped mandrel, push the sock 810 onto the mandrel to form wrinkles with layers 820 along the Z-direction or otherwise transverse to the X-axis, then stack concentric layers 400 around the sock 810, then lay a resin film over the sock 810, and then cure the assembly.

In some embodiments, the sock 810 may be formed and cured before being placed into the bat assembly. For example, the sock 810 may be formed with a fiber mat, compressed onto a mandrel to form wrinkles, placed in a mold, injected with resin, cured, then cut into pieces to be added to a composite assembly, between the concentric layers 400.

In some embodiments, other components may form the wrinkled interface that creates the layers 820. For example, in some embodiments, a sheet of material, such as pre-preg material, may be wrapped around the circumference of a mandrel and pushed or wrinkled into a pleated arrangement to form folds constituting the layers 820. The sock 810 or other wrinkled materials provide convenient ways to create interfaces between secondary (for example, transverse) layers and in the Z-Y plane (such as the layers 820).

Figure 9:
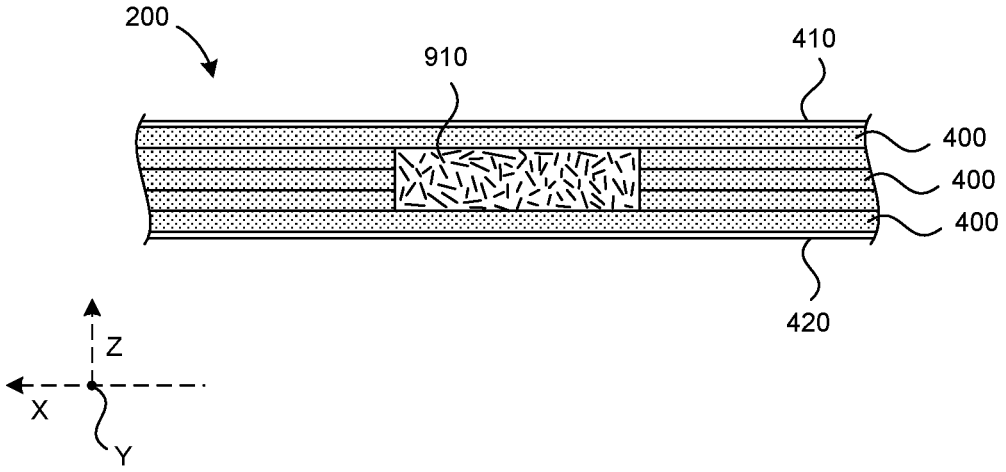
FIG. 9 illustrates a cross-section of a portion of a bat wall according to another embodiment of the present technology.

FIG. 9 illustrates a cross-section of a portion of a ball bat, such as a barrel wall 200, according to another embodiment of the present technology. FIG. 9 illustrates a section that may be positioned in Area A in FIG. 2, for example, and it may be generally similar to the section of the bat wall illustrated and described above with regard to FIG. 4. However, instead of, or in addition to, an arrangement of secondary layers (430 in FIG. 4) oriented transverse (such as perpendicular or oblique) to the primary or concentric layers 400, a section of bulk molding compound 910 or similar material may be positioned in the barrel wall 200 (for example, forming a ring within the barrel wall).

In some embodiments, the bulk molding compound 910 may be laid up and cured simultaneously with the concentric layers 400 according to various composite manufacturing methods. The bulk molding compound disrupts interlaminar shear fractures between the concentric layers 400 and also limits or prevents proliferation of fractures along the Z-direction (radial direction) of the barrel wall 200. In various embodiments, any suitable number of concentric layers 400 may be used in the barrel wall 200, and in some embodiments, there may be a concentric layer 400 between the bulk molding compound 910 and one or both of the outer and inner skins 410, 420. In some embodiments, the bulk molding compound 910 may be directly adjacent to one or both of the outer and inner skins 410, 420 (without a concentric layer 400 between the bulk molding compound 910 and the outer skin 410 or the inner skin 420).

Figure 10:
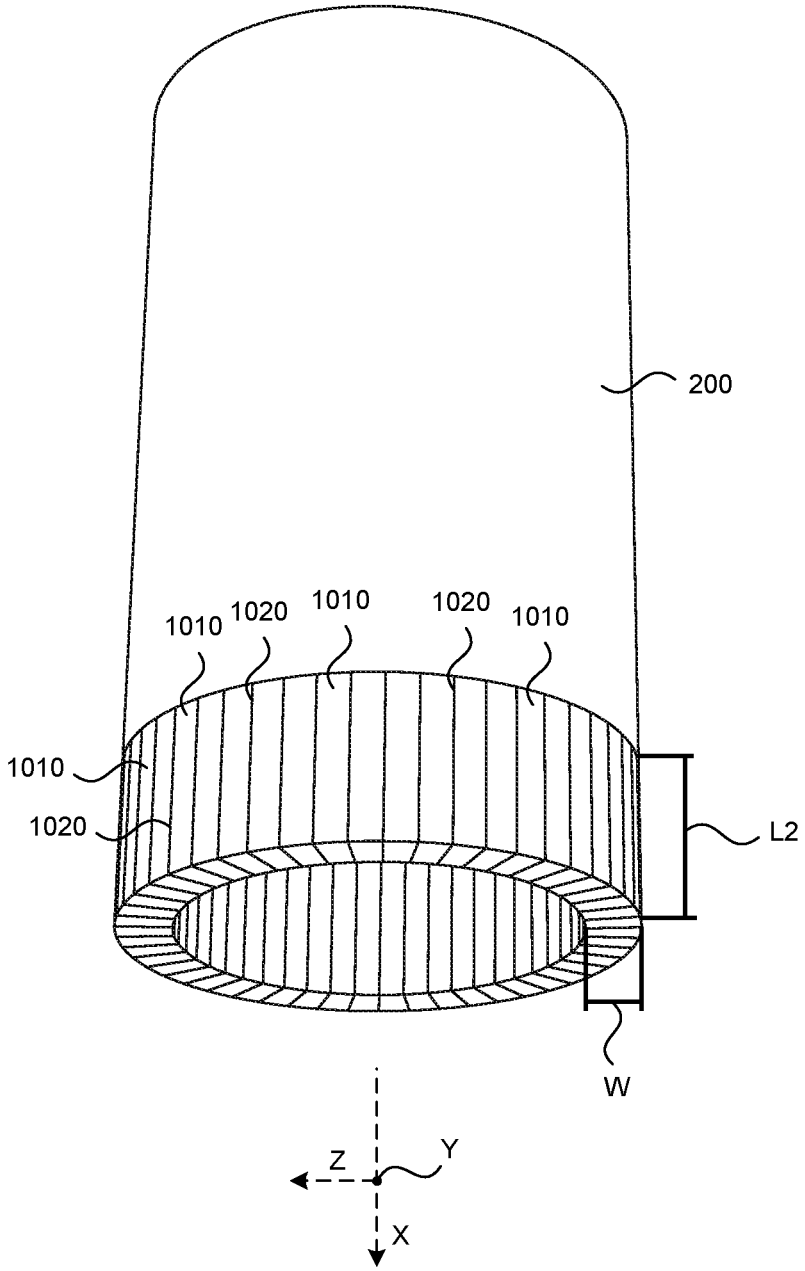
FIG. 10 illustrates a schematic sectional view of a portion of a ball bat, such as a barrel wall, according to another embodiment of the present technology.

FIG. 10 illustrates a schematic sectional view of a portion of a ball bat, such as a barrel wall 200, according to another embodiment of the present technology. In some embodiments, secondary layers 1010 may be positioned in the ball bat composite structure in a radial orientation relative to the X-axis, and in a lengthwise orientation along the X-axis of the ball bat, such that the interlaminar interfaces 1020 span a length L2 of a portion of the ball bat along the X-axis. The secondary layers 1010 may be generally straight along the X-axis as they span the length L2, rather than being curved around, or cut to form a curve around, the X-axis (curved secondary layers 430 are shown in FIGS. 4-6). In some embodiments, the secondary layers 1010 may form most or all of the overall wall thickness W of a bat wall, as shown in FIG. 10. In other embodiments, other layers or skins may cover the secondary layers 1010, inside the bat wall, outside the bat wall, or both.

Figure 11:
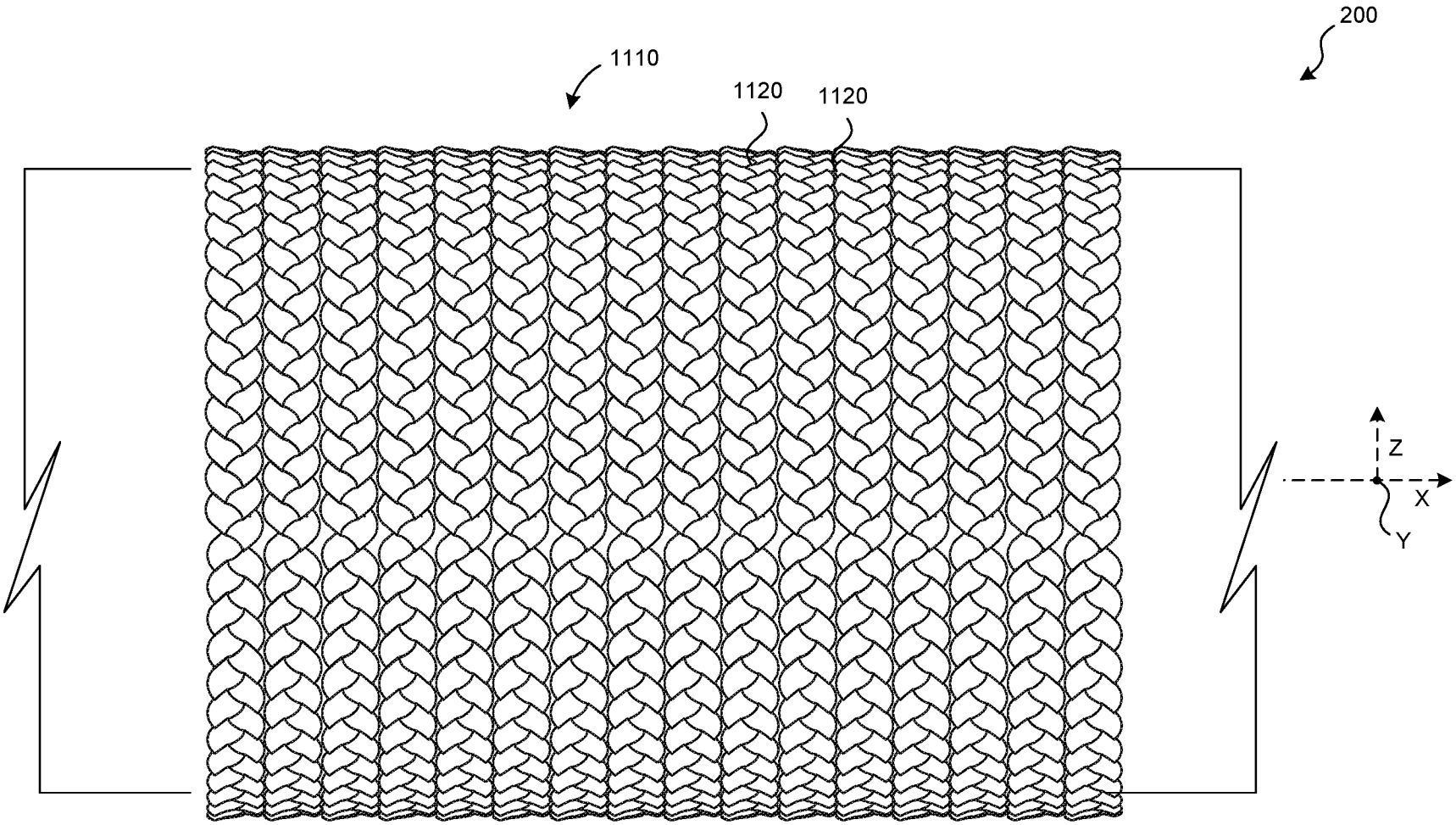
FIG. 11 illustrates a side view of a portion of a partially constructed ball bat, such as a portion of a barrel wall, according to another embodiment of the present technology.

FIG. 11 illustrates a side view of a portion of a partially constructed ball bat, such as a portion of a barrel wall 200, according to another embodiment of the present technology. In some embodiments, a braided or twisted rope 1110 may be wrapped around a mandrel or otherwise circumferentially incorporated into the wall 200 of a ball bat. By incorporating a wrapping of rope 1110 into the bat wall structure, adjacent coils or wraps 1120 may form transverse layers functioning similarly to the secondary layers 430 described above with regard to FIG. 4. For example, the coils or wraps 1120 provide interlaminar interfaces in the Z-Y plane.

In some embodiments, the rope 1110 may be laid up with the concentric layers of laminate (see FIG. 4) and cured in a resin transfer molding (RTM) process. In other embodiments, the rope 1110 may be formed using pre-preg material and cured simultaneously with other pre-preg materials in the assembly (such as the concentric layers 400). In some embodiments, approximately 80% to 90% of the fibers in the rope 1110 may be oriented along the Z-direction (radially) or in the Z-Y plane.

Embodiments of the present technology provide multiple advantages. For example, embodiments of the present technology provide interlaminar interfaces or shear interfaces along the Z-axis, in the Z-Y plane, or otherwise radially outward from, or transverse to (such as perpendicular or oblique to), the X-axis. Such interfaces provide less of an increase in trampoline effect, or no increase in trampoline effect, when they fracture, unlike when interfaces along the X-axis fracture. Accordingly, ball bats according to embodiments of the present technology are less prone to unfair performance increases or violations of league rules when the bats are used or abused (such as in an ABI process).

The inventors discovered that fibers or interfaces oriented generally along a Z-direction according to various embodiments of the present technology resist or even prevent delamination along the X-Y plane or along the length of the ball bat. The fibers or plies in the Z-direction may resist a crack running only along the X-axis. Accordingly, bats according to embodiments of the present technology may fail along the Z-direction before they fail along the X-Y plane, so they become disabled after an ABI procedure rather than gaining performance beyond regulations.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in some embodiments, composite laminate material may be replaced by or supplemented with sheet molding compound or bulk molding compound. In some embodiments, the quantity of fibers oriented along a direction transverse to the longitudinal axis of the bat may be more than ten percent of a total quantity of fibers in a given portion of the barrel wall.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat comprising:

a handle; and a barrel attached to or continuous with the handle along a longitudinal axis of the bat, the barrel comprising a barrel wall including a first plurality of concentric composite laminate plies and a second plurality of concentric composite laminate plies, wherein the first plurality of concentric composite laminate plies is spaced apart from the second plurality of concentric composite laminate plies along the longitudinal axis to form a gap between the first plurality of concentric composite laminate plies and the second plurality of concentric composite laminate plies;

wherein the barrel wall further comprises a plurality of coils of a rope material positioned in the gap, wherein a shear interface is located between two of the coils, the shear interface being oriented transversely relative to the first plurality of concentric composite laminate plies and the second plurality of concentric composite laminate plies.

2. The ball bat of claim 1, further comprising an outer skin on the barrel and an inner skin on the barrel.

3. The ball bat of claim 1 wherein the coils of the rope material are positioned about a center of percussion of the ball bat.

4. The ball bat of claim 1 wherein the shear interface is oriented perpendicular to the first plurality of concentric composite laminate plies.

5. The ball bat of claim 1 wherein the first plurality of concentric composite laminate plies comprises 26 concentric composite laminate plies, and at least one coil of the rope material has a thickness along a direction perpendicular to the longitudinal axis equivalent to a total thickness of between 22 and 24 of the first plurality of concentric composite laminate plies.

6. A ball bat comprising:

a handle; and a barrel attached to or continuous with the handle along a longitudinal axis of the bat, the barrel comprising a barrel wall; wherein the barrel wall comprises:

a first plurality of concentric composite laminate plies;

a second plurality of concentric composite laminate plies spaced apart from the first plurality of concentric composite laminate plies along the longitudinal axis; and a rope material positioned in a gap located longitudinally between the first plurality of concentric composite laminate plies and the second plurality of concentric composite laminate plies, wherein the rope material comprises a plurality of coils and interfaces between the coils, the interfaces being distributed along at least part of the longitudinal axis and oriented transversely relative to the first and second pluralities of concentric composite laminate plies.

7. The ball bat of claim 6 wherein the barrel wall comprises an outer skin facing an exterior of the ball bat and an inner skin facing a hollow interior region of the ball bat.

8. A ball bat comprising:

a handle; and a barrel attached to or continuous with the handle along a longitudinal axis of the bat, the barrel comprising a barrel wall; wherein the barrel wall comprises a plurality of first interlaminar interfaces extending along at least a portion of the longitudinal axis of the bat, and the barrel wall comprises a plurality of second interlaminar interfaces extending along directions transverse to the longitudinal axis of the bat, wherein the plurality of second interlaminar interfaces is formed between wrinkles of a tube material.

9. The ball bat of claim 8 wherein an average thickness of the plurality of second interlaminar interfaces comprises approximately ten percent of a thickness of the barrel wall.

* * * * *